US011605270B2

(12) United States Patent
Hill

(10) Patent No.: US 11,605,270 B2
(45) Date of Patent: Mar. 14, 2023

(54) TENNESSEE HOLD 'EM® POKER TOURNAMENTS

(71) Applicant: Scott Arthur Hill, London (GB)

(72) Inventor: Scott Arthur Hill, London (GB)

(73) Assignee: Scott Arthur Hill, New Hope, PA (US)

( * ) Notice: Subject to any disclaimer, the term of this patent is extended or adjusted under 35 U.S.C. 154(b) by 334 days.

(21) Appl. No.: 16/706,690

(22) Filed: Dec. 7, 2019

(65) Prior Publication Data

US 2021/0174647 A1 Jun. 10, 2021

(51) Int. Cl.
*G07F 17/32* (2006.01)

(52) U.S. Cl.
CPC ..... *G07F 17/3293* (2013.01); *G07F 17/3209* (2013.01); *G07F 17/3262* (2013.01); *G07F 17/3276* (2013.01)

(58) Field of Classification Search
None
See application file for complete search history.

(56) References Cited

U.S. PATENT DOCUMENTS

2019/0035224 A1* 1/2019 Okahara ..... G07F 17/3223

* cited by examiner

*Primary Examiner* — Robert T Clarke, Jr.

(57) ABSTRACT

Systems with methods of providing a strategic poker tournament for 3-9 players, utilising a sequentially programmed electronic microprocessor, downloadable on 'smart' devices or in another embodiment, on gaming tables or gaming machines, known as "Tennessee Hold 'Em® Tournaments", are defined:

Figure 1:
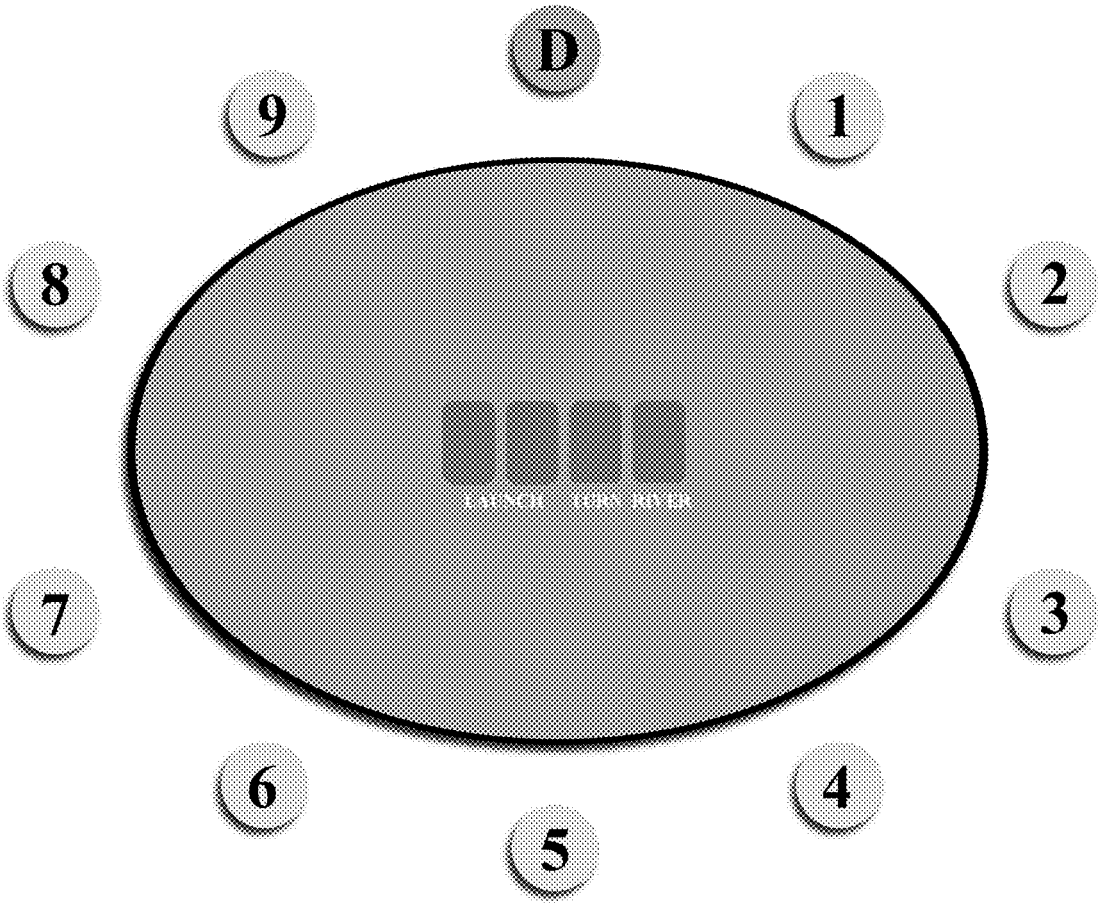

These methods provide beneficial stimulation of participants' cognitive brain activity through prompted continuous strategic thought. Systems include a bespoke method of "loaning" chips which eliminates inequitable 'side pots'.

Systems exclude players holding 4 hole cards from using the final community card, and Players holding 5 hole cards from using the penultimate and final card distributions, so participants create their own strategy.

Prizes are awarded when two players remain. Chips are totaled and the winner's chips are divided by the total chips to determine the percentage split between the finalists.

6 Claims, 13 Drawing Sheets

TENNESSEE HOLD 'EM® POKER TOURNAMENTS

BACKGROUND OF THE INVENTION

Poker is a popular card game played worldwide, and the statistics are staggering. To provide some insight into how many people play poker, the World Poker Tour (or WPT) states that from online poker alone, there are 100 million online poker players worldwide, with 60 million in the United States alone.

In both online and real world Poker, popular games, Texas Hold 'Em and Omaha have inherent drawbacks which are built into the game mechanics and betting structure. Research reveals that 50 to 70% of all players fold at the start of any hand in Texas Hold 'Em. Players have a much lower participation rate than in any other casino or card game. This low participation rate applies to both traditional land based casinos as well as online 'virtual' casino websites and downloadable applications. This low participation rate is detrimental for players as well as the 'house' (a licensed poker room or casino). With thorough analyses of Texas Hold 'Em available ubiquitously, players play 'by the book', allowing limited opportunities for any creative strategic play (other than bluffing). In both Texas Hold 'Em and Omaha, 'Pot Limit' and 'No Limit' betting allows players with a large chip count to 'bully' players with a small chip count. This is unpopular with a majority of players, because both 'Pot Limit' and 'No Limit' betting require complex 'side pots' whenever players run out of chips. In Omaha, players are dealt 4, personal use 'hole cards'. If a player is dealt 3 or 4 of a Kind, they must still discard 2 cards, meaning they will be forced to throw away their high ranking hand. As an overview, current popular Poker has low participation percentages and limited potential for strategic card play, limiting positive frontal lobe brain stimulation. Systems and methods employed in the game mechanics and betting structure of Tennessee Hold 'Em® Poker Tournaments offer a resolution to these limitations and more, focusing on increased participation, advanced decision making, sharp observation, and innovative bluffing with a progressive, more equitable betting structure. In 2019, confidential meetings with the Kahnawake and Pechanga Gaming Commissions (CA) covered all aforementioned topics, indicating that this invention has genuine potential for benefitting both the iGaming community and the tribes as a whole.

BRIEF SUMMARY OF THE INVENTION

"Tennessee Hold 'Em® Poker Tournaments" are systems and methods of supplying a poker tournament competition to 3 to 9 players, which, viewed as a totality, also provides an improved technique for conducting business in the gaming and Poker industries, using a programmed microprocessor, via an electronic device or gaming machine, or on a gaming table, comprising 7 related innovative variations of Poker which employ an integral, progressive method of betting to create a new form of Poker tournament that benefits recreational players, casual and serious players and licensed Poker operators on the internet and in the real World. Seven programming variations of the "Tennessee Hold 'Em" game are defined. Each variation follows similar rules and methods, regarding named rounds of dealing, betting, and card shedding. All variations share the same programming which creates an integral progressive betting and banking system. Since each hand unfolds progressively during the first 3 card distributions, more players stay in the hand longer than in current popular variations, Texas Hold 'Em and Omaha. Because more players have higher ranking hands than in Texas Hold 'Em, more players compete for the pot in the showdown. Game mechanics built in to the system programming allow players to use an innovative technique of hand-building, whereby players must decide whether to discard 1 or 2 hole cards, or to hold all hole cards, increasing strategic decision making. Discards, known as 'Men Overboard' are automatically revealed, allowing opponents insight into other players' hands, as well as allowing players to select unique new tactical forms of bluffing.

All Figures depict programming for the default tournament variation, known as "Tennessee Riverboat (223)", with 223 referring to the number of cards dealt during the first 3 card distributions. A 52, virtual fifty two card deck is employed, including 4 suits, Hearts, Diamonds, Clubs and Spades, with 13, thirteen, ranked cards in each suit. Variations Summary: All variations follow the conventional hand rankings in the game of Poker. All variations are programmed for 3 to 9 players via electronic devices. Each variation has a 3 digit reference number, defined by the number of cards distributed in the first 3 rounds of dealing, consisting of:

1st Card Distribution=First digit: 'Hole Cards'=(1, 2, or 3 cards), dealt to each player.

2nd Card Distribution=Second digit: 'The Launch'=2 shared community cards. This second card distribution is identical in all variations.

3rd Card Distribution=Third digit: 'The Boat'=(1, 2, 3, or 4 cards), dealt to each player. Note: Five Hole card variations are advanced difficulty and are more challenging than four Hole card variations.

(1) "Tennessee Riverboat (223)"=5 Hole Cards (Default Variation)
(2) "Tennessee Gambler (222)"=4 Hole Cards
(3) "Tennessee Hustler (322)"=5 Hole Cards
(4) "Tennessee Big Hole (321)"=4 Hole Cards
(5) "Tennessee Red Dog (124)"=5 Hole Cards
(6) "Tennessee Slow Hand (123)"=4 Hole Cards
(7) "Tennessee Steamer (421)"=5 Hole Cards The primary objectives of this invention are to stimulate greater participation, and encourage creative strategic decision making, stimulating positive brain function, within the established Poker community, skill gaming and recreational player markets, by programming an electronic processor using systems and methods described herein. In another embodiment, the processor is programmed to utilise a Random Number Generator to shuffle, clone the deck, and deal the cards, to provide a genuine Skill Poker version of Tennessee Hold 'Em® Poker Tournaments. Using this ideal learning tool, Players play asynchronous matches, where 2 human players must try to outwit AI Robot opponents. These "bots" are programmed with betting characteristics that mimic different types of Poker players, including 'tight', 'loose' or 'bluffing' bots, and these characteristics appear in identical seating positions for match play, where 2 or more human players must play a series of identical hands. The player with the greater chip count at the end of this series of hands, or an entire Tournament, has played their cards more skillfully, and the processor is programmed to award the pot to that player who is declared the Match Winner. The primary objective of Tennessee Hold 'Em® Skill Poker Tournaments is to create a different kind of Poker Championship, where skill tournament winners can genuinely claim to be the best players in the World. Thus, Tennessee Hold 'Em® Poker Tournaments also provide a strategic game which appeals to the growing skill gaming market worldwide.

BRIEF DESCRIPTION OF THE SEVERAL VIEWS OF THE DRAWINGS: FIGS. 1-13

FIG. 1 (Page 50): Virtual Table Felt Design, Player and Dealer Seating Positions:

D=Virtual Dealer Seating Position. 1, 2, 3, 4, 5, 6, 7, 8, 9=Player seating positions The center of the virtual table has four shaded rectangles, which are labelled below, where the virtual Dealer will place four community cards, face upward, during each hand. The second card distribution is positioned in the two left hand most rectangles labelled, "LAUNCH". The fourth card distribution, adjacent to the LAUNCH, is positioned in the single rectangle labelled, "TURN". The fifth card distribution, adjacent to the TURN, is positioned in the single rectangle labelled, "RIVER".

Figure 2:
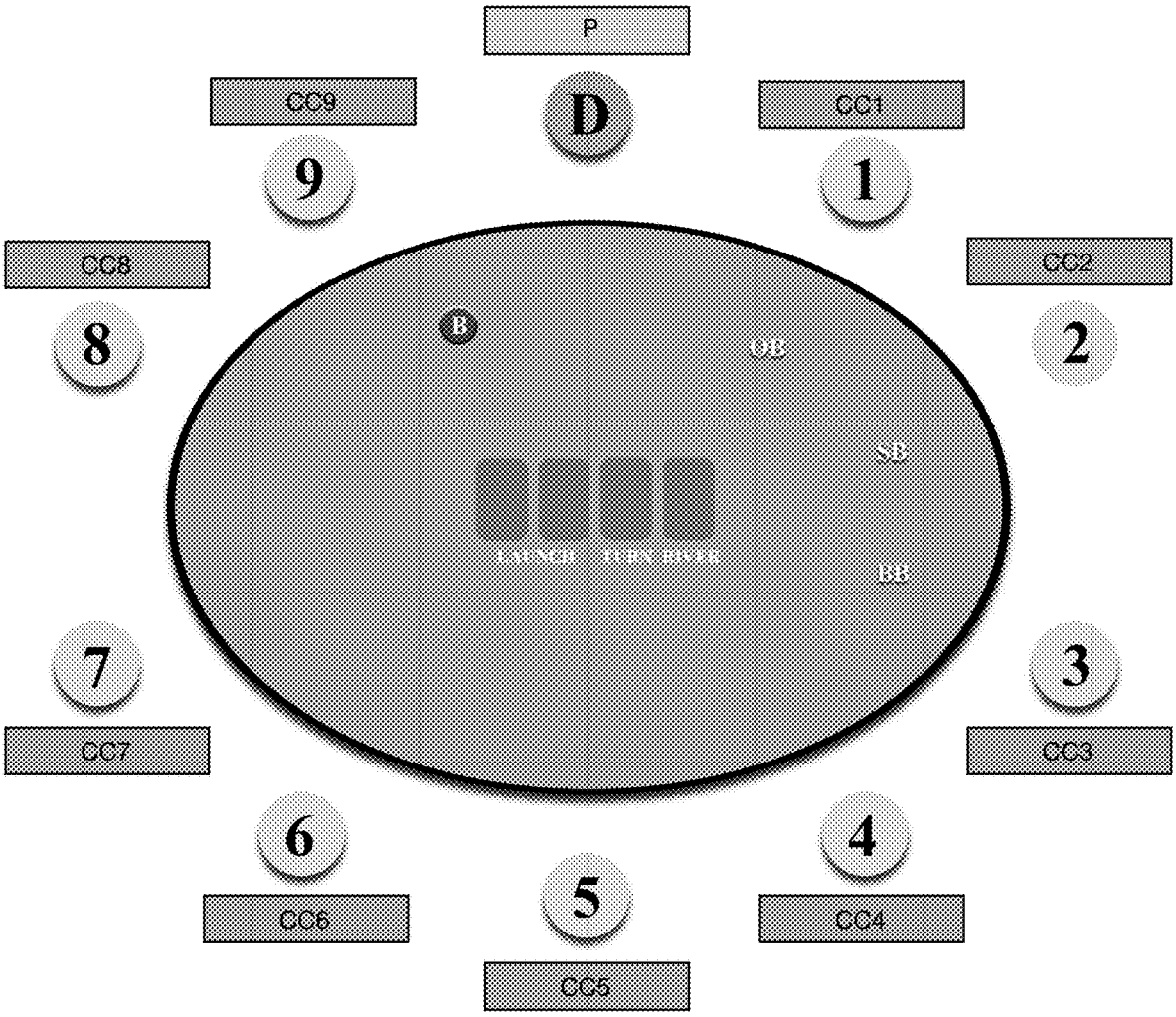

FIG. 2 (Page 51): Button, 'Blind' Bets, Players' Chip Counts and Pot:

B=Button automatically indicates which player will be last to receive cards. That player is also last to act in Betting Rounds 2, 3, 4 and 5. The Dealer Button moves in a clockwise direction to player 1 for the second hand, and then on to player 2 for the third hand, etc. . . .

OB='Opening Blind'=½ the 'Small Blind'. Player 1 automatically posts the 'Opening Blind'.

SB='Small Blind'=½ the 'Big Blind'. Player 2 automatically posts the 'Small Blind'.

BB='Big Blind'=4×'Opening Blind". Player 3 automatically posts the 'Big Blind'.

P=Hand Pot=Digital display: Total of all bets and raises during the current hand CC1, CC2, CC3, CC4, CC5, CC6, CC7, CC8, CC9=Digital display: Chip Count for Players 1-9 inclusive.

The processor is programmed to enable Player 4 as the first to act in Betting Round 1.

The processor is programmed to enable Player 1 as the first to act in Betting Rounds 2 though 5. If player 1 folds, the processor is programmed to select the next player sitting to the left of player 1, who has not folded.

Total chip count is calculated and displayed digitally adjacent to each player's seating position at the virtual table.

Figure 3:
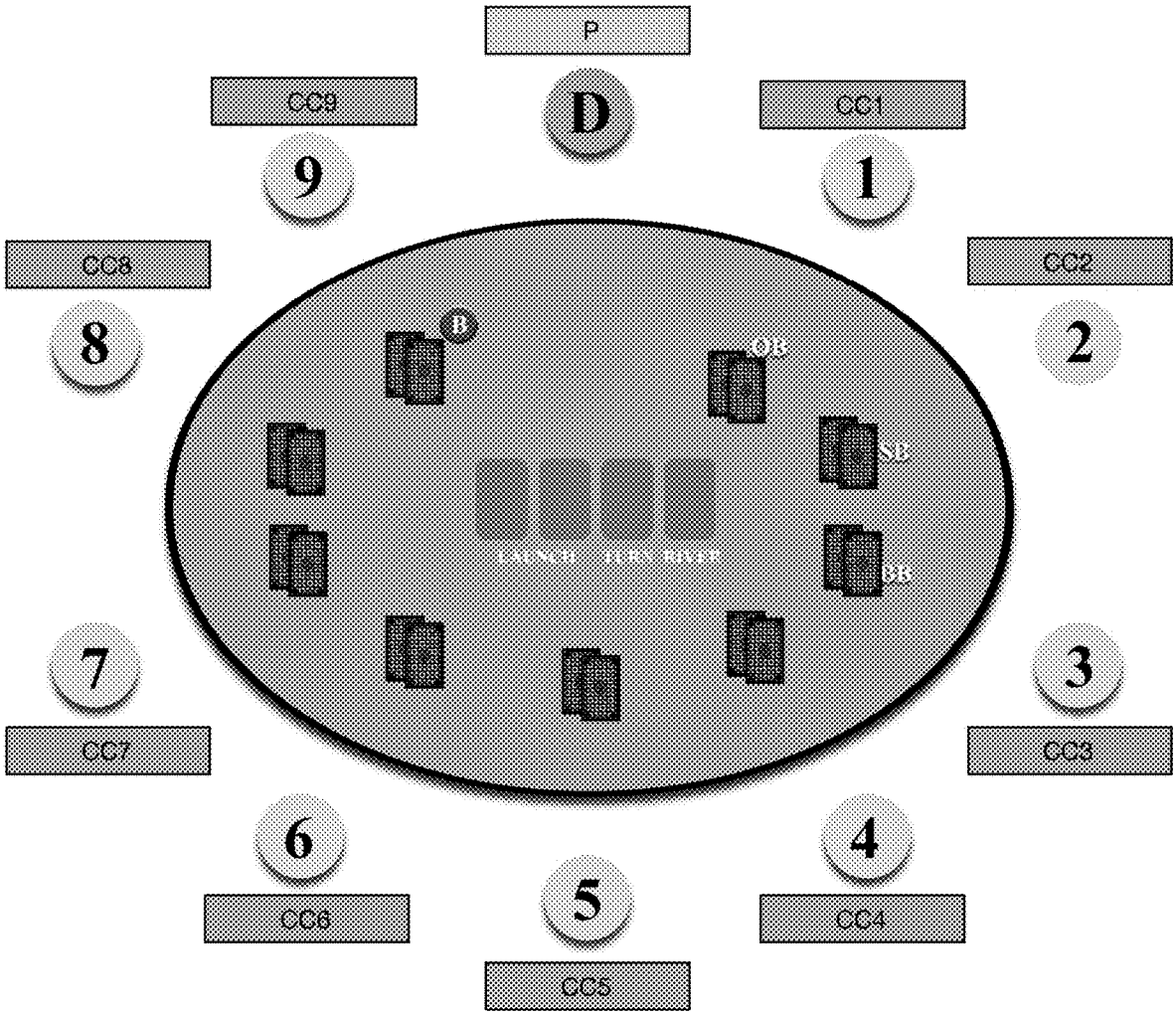

FIG. 3 (Page 28): First Card Distribution, 'Hole Cards': The processor is programmed to distribute two personal 'Hole Cards' to each player. 'Hole Cards' are defined as cards that each individual player holds and views privately. 'Hole Cards' may be used exclusively by that player to create their best ranking 5 card poker hand.

Figure 4:
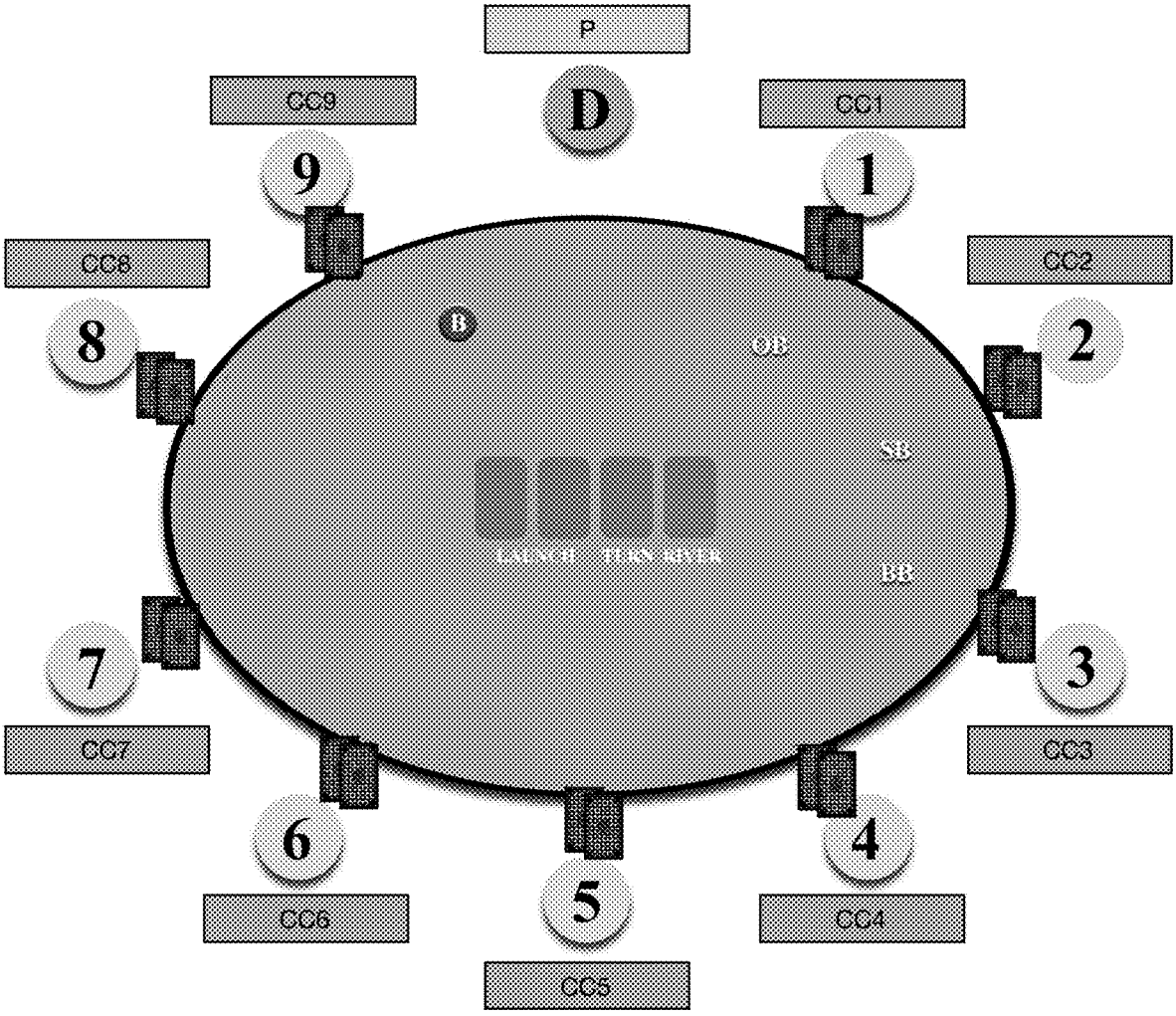

FIG. 4 (Page 52): First Card Distribution, Players view their 'Hole Cards':

Betting Round 1 takes place. Processor is programmed for action to begin with Player 4. Maximum bet or Raise=100 u per player. One raise is permitted per player.

Figure 5:
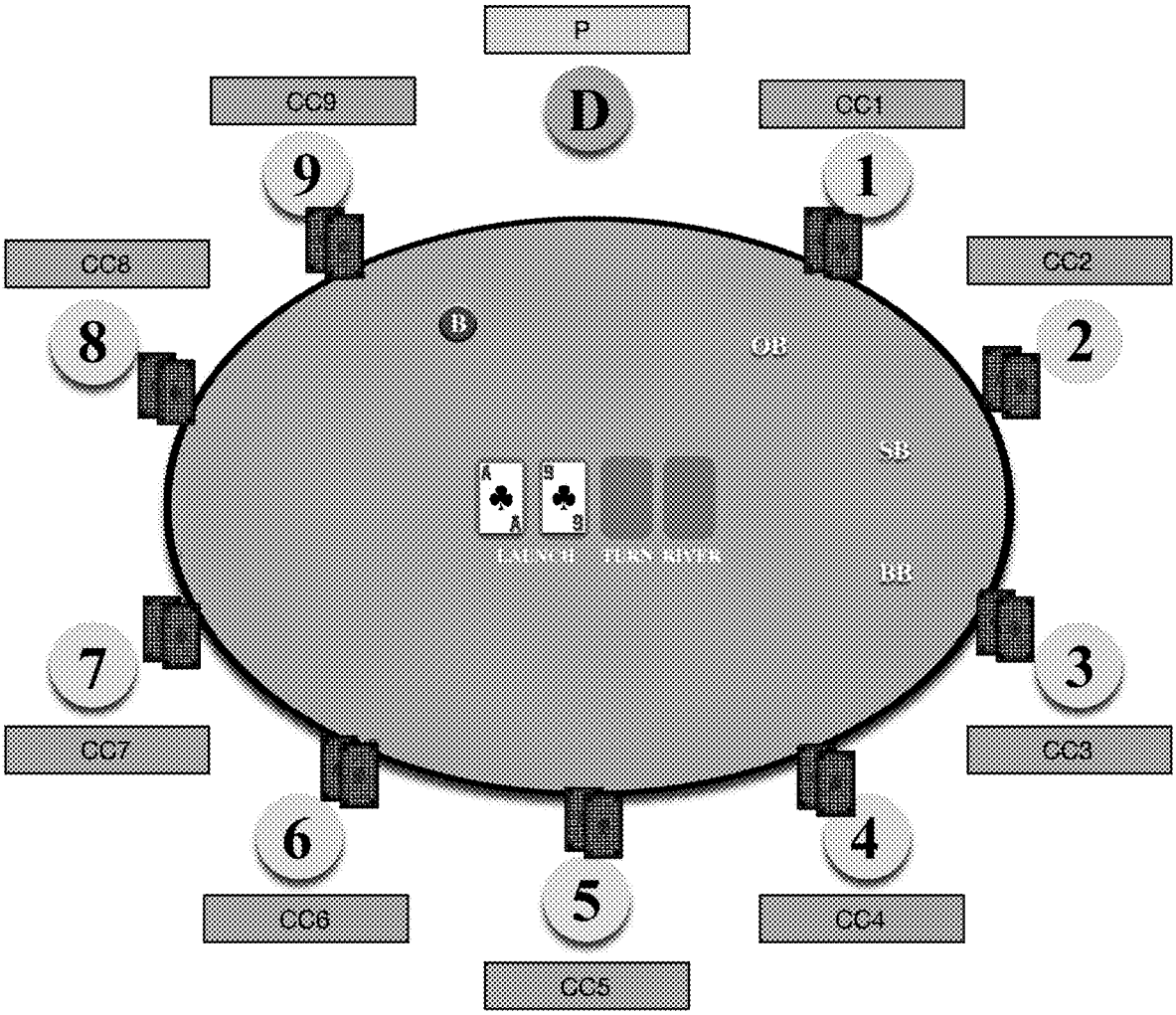

FIG. 5 (Page 53): 2nd Card Distribution—'The Launch'—Virtual Dealer deals 2 'community' cards:

The processor is programmed to distribute the first and second 'Community Cards', face upward, in the centre of the table, where the two left hand rectangles labelled "LAUNCH" are indicated. Betting Round 2 takes place. The programming indicates that Player 1 is first to act in Betting Round 2. If Player 1 folds, then the next Player sitting in a clockwise direction who has not folded, automatically starts the betting. This principle applies to all subsequent rounds of betting. In Betting Round 2, the processor is programmed to limit the maximum bet or raise to 200 u. Two raises are permitted per player.

Figure 6:
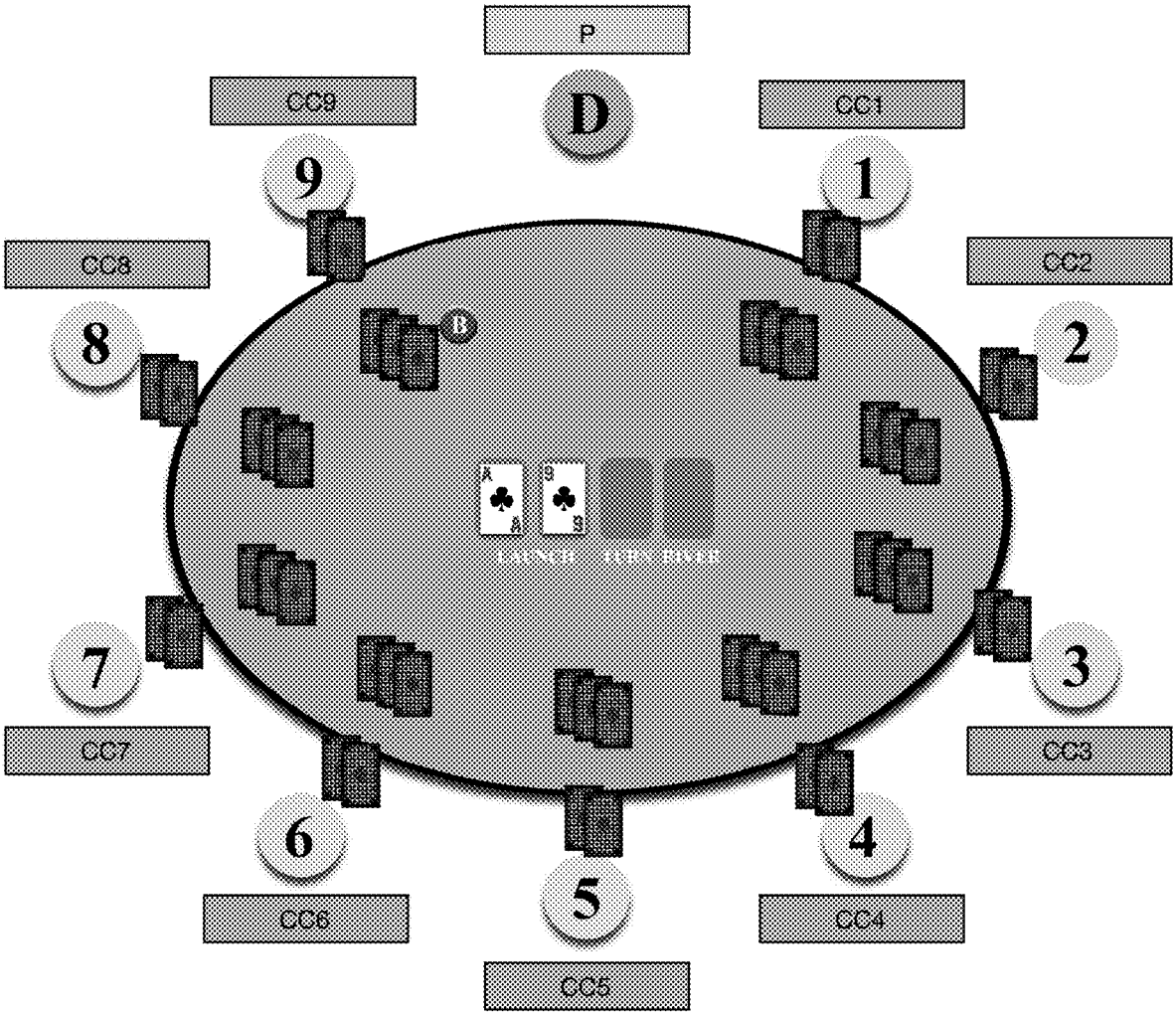

FIG. 6 (Page 54): 'The Boat'—The processor is programmed to distribute 3 more Hole Cards to each player.

Figure 7:
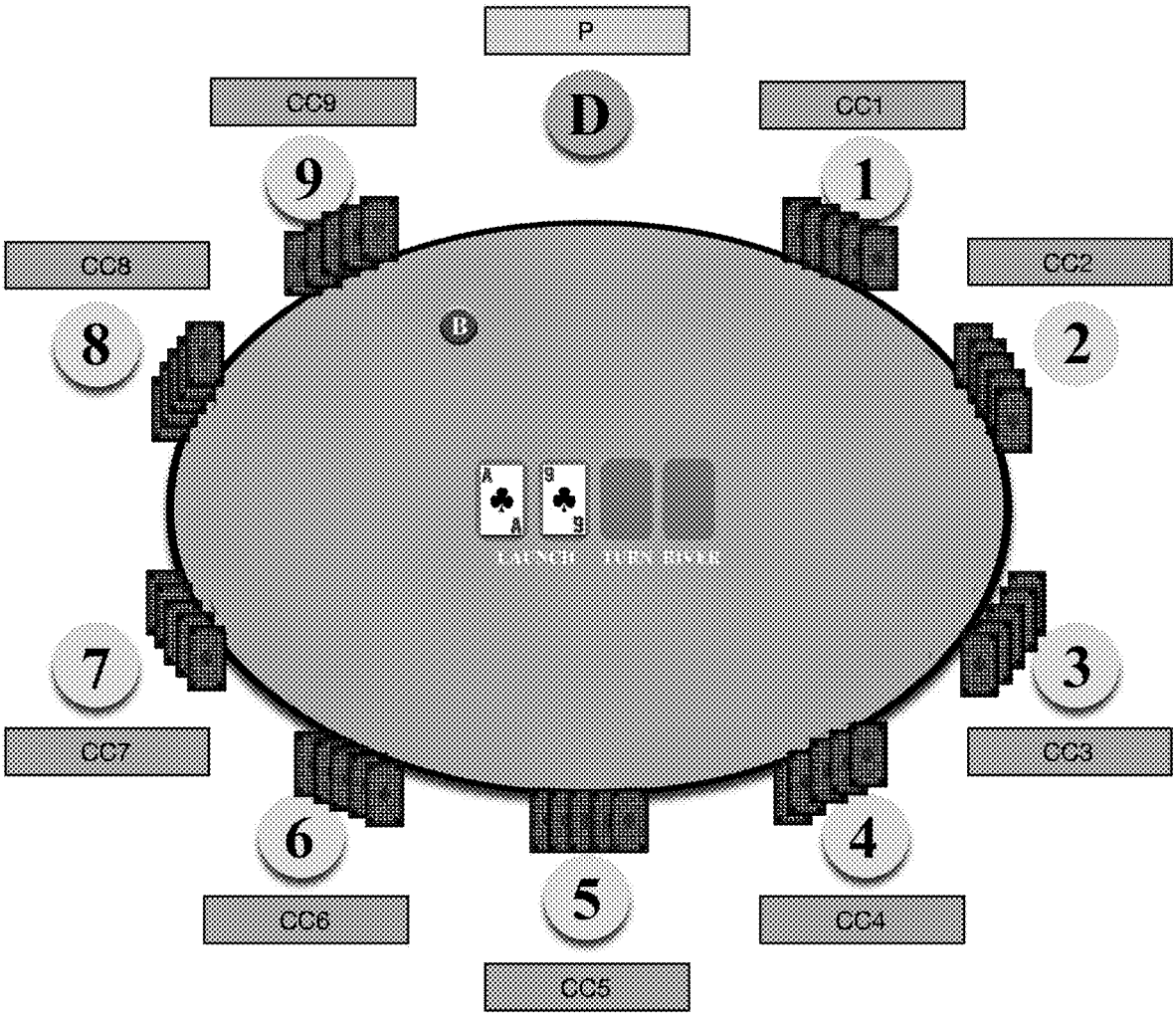

FIG. 7 (Page 55): Players view all 5 Hole Cards, aka, 'The Boat':

Each player now holds 5 'hole cards' and Betting Round 3 takes place on 'The Boat'. The processor is programmed to limit maximum bet or raise to 300 u per player. Three raises are permitted per player. Note: In Tennessee Hold 'Em variations (223), (124), (322) and (421) each player holds 5 'hole cards'. In variations (222), (123) and (321), each player holds 4 'hole cards.

Figure 8:
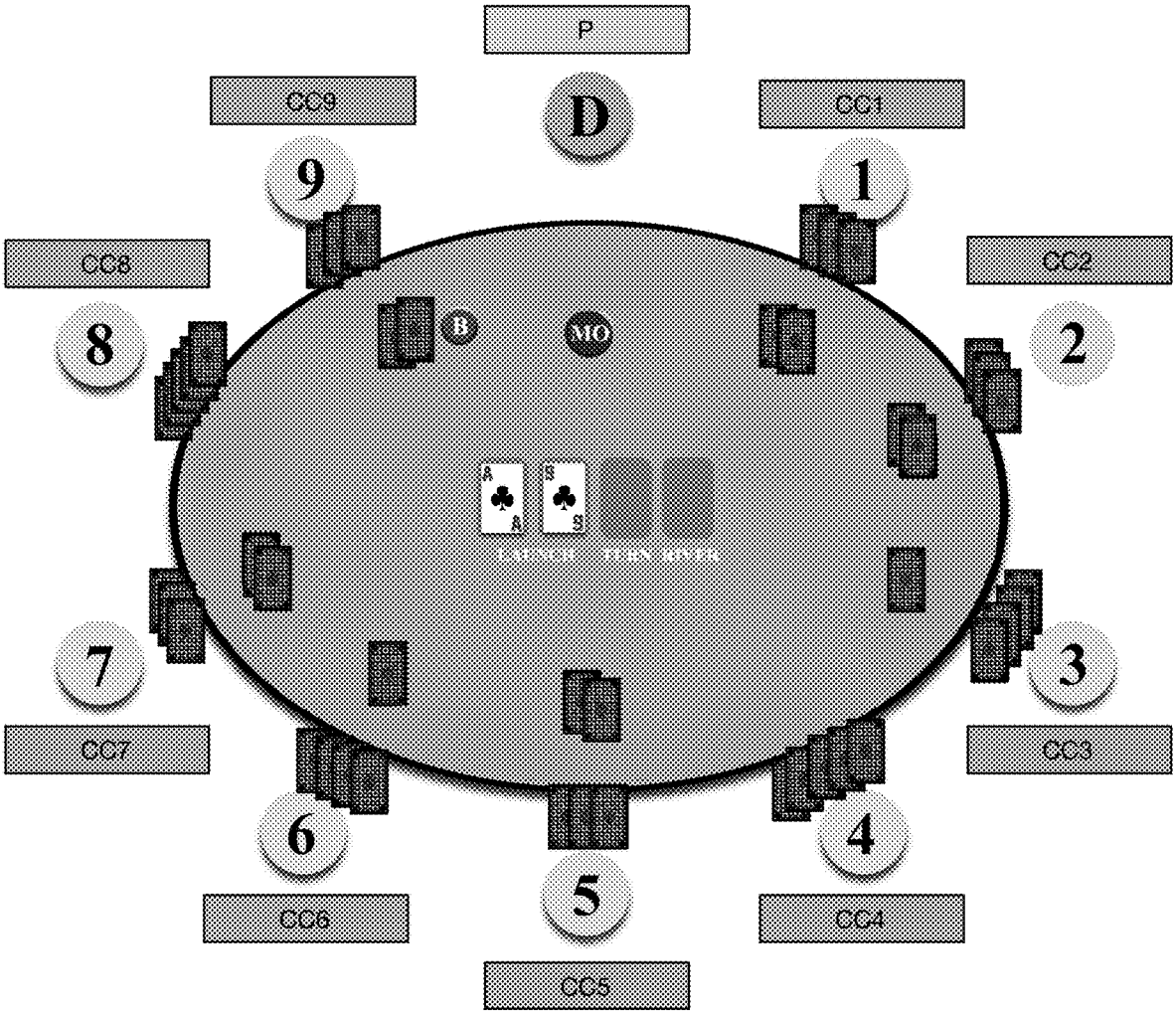

FIG. 8 (Page 56): MO='Men Overboard', digital notification. The processor is programmed to notify players that they may now discard up to two hole cards, or 'stick' (discard zero hole cards).

'Men Overboard' notification automatically appears. Now players may discard if they wish. Example Depicted: Players 4 and 8 choose to 'stick' with the 5 'hole cards' they have been dealt.

Note: Any player choosing to 'stick' with 5 hole cards is automatically excluded from using the third community card ('the Turn'), or the fourth community card ('the River') in their best 5 cards (of 7 allowed cards) poker hand. Players 3, and 6 discard one hole card and place it face down on the table. Players 1, 2, 5, 7 and 9 select two hole cards to discard and these cards automatically appear (in front of each player's respective seating position) face down on the table.

Figure 9:
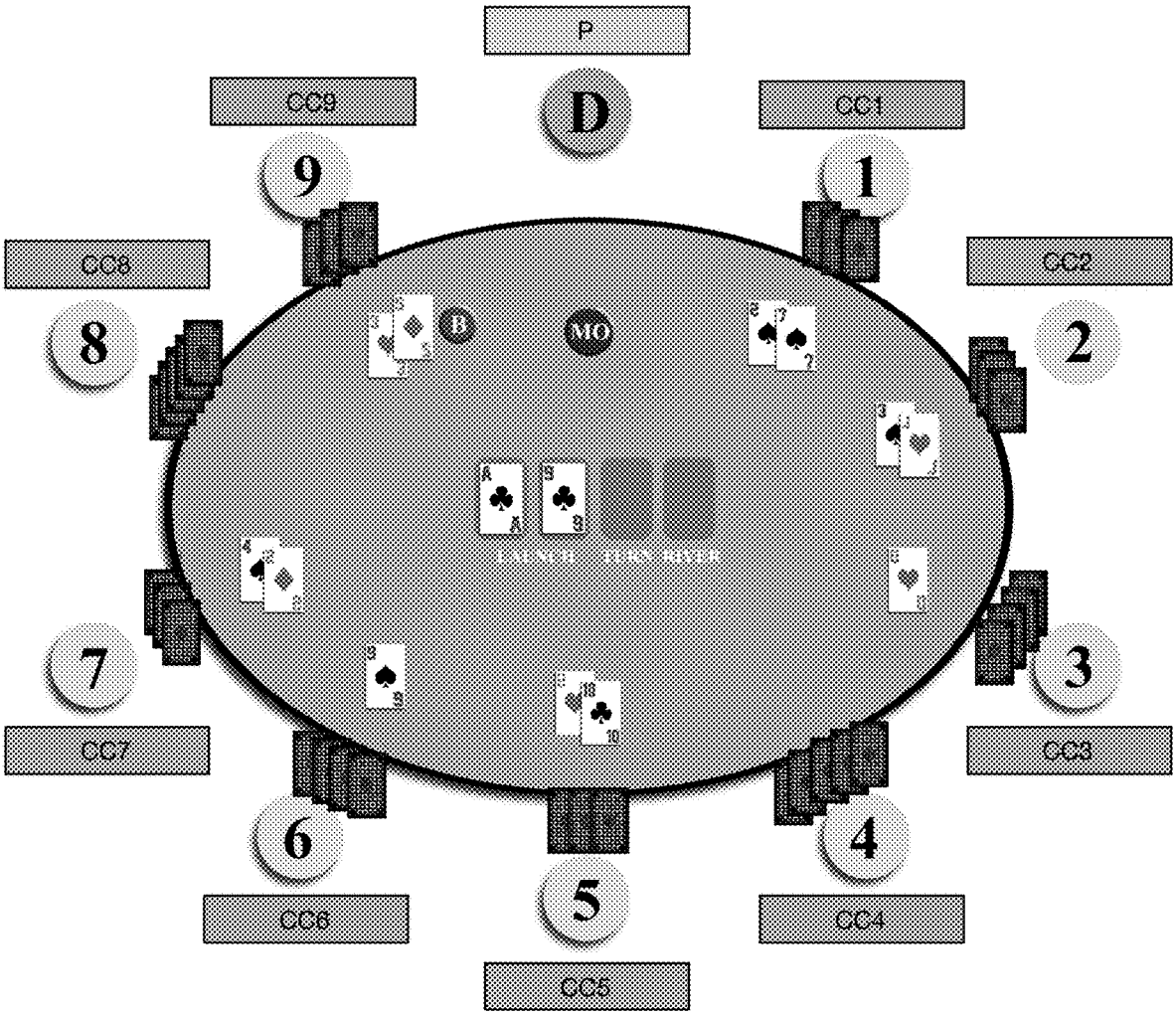

FIG. 9 (Page 57): 'Men Overboard' discards are automatically revealed:

When all players have completed discarding or chosen to stick, discards are automatically revealed. Discarded "Men Overboard", may provide insight into an opponent's hand, or alter the odds of players receiving a favourable 'Turn' or 'River'.

Figure 10:
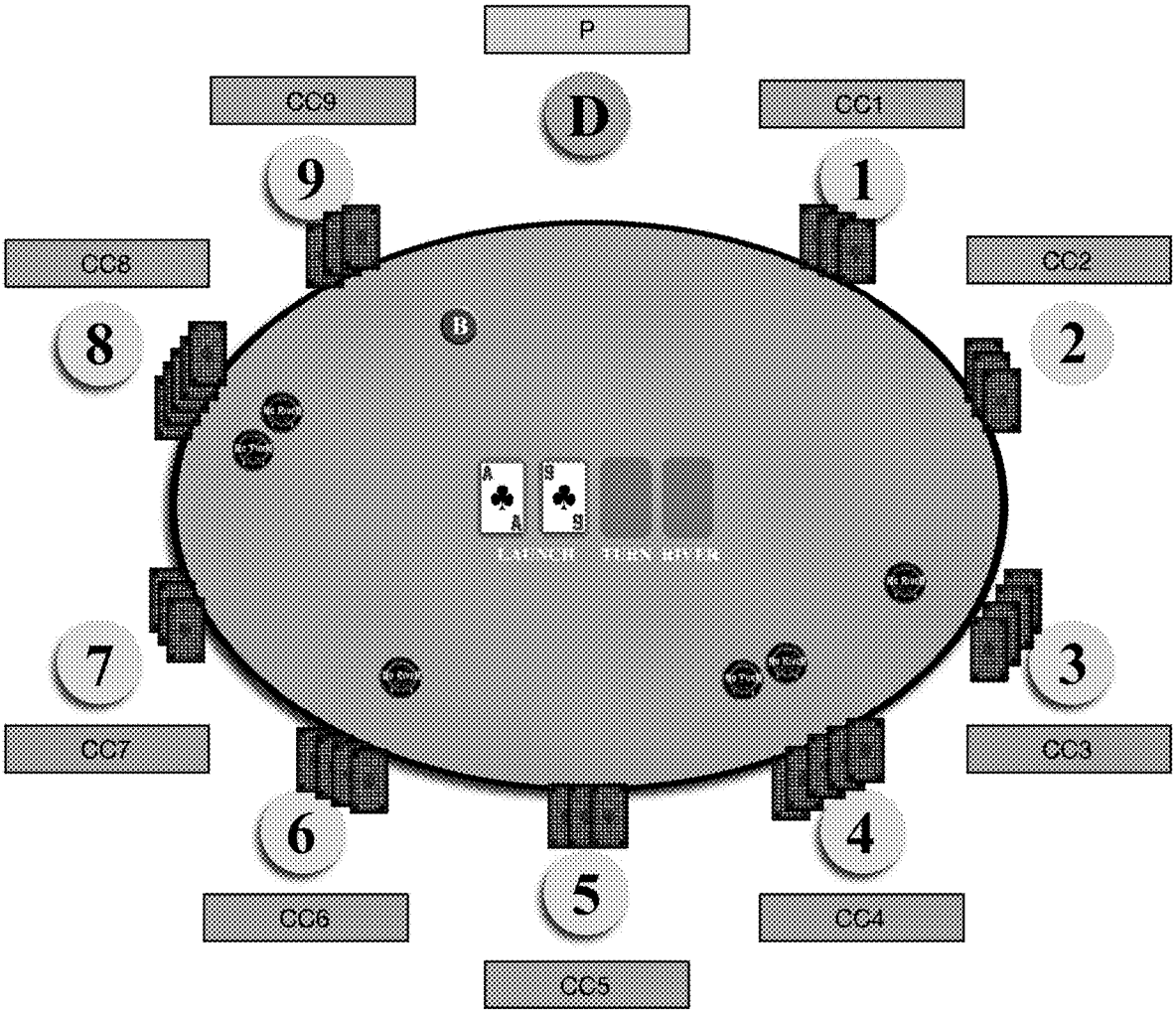

FIG. 10 (Page 58): Distribution of "NO RIVER" and "NO TURN" Markers:

For players who choose to retain all 5 hole cards: "No Turn" and "No River" markers appear automatically on the table, adjacent to their table position to show opponents that Players 4 and 8 have retained all five hole cards, and are permitted to use neither the "TURN" nor the "RIVER" community cards in their best 5 card Poker hand of 7 allowed cards.

For players who choose to retain 4 hole cards: 'No River' markers appear automatically to show opponents that Players 3 and 6 have retained four hole cards and are not permitted to use 'the River', final community card, in their best 5 card Poker hand (of 7 permitted cards), and a "NO RIVER" marker appears automatically on the table adjacent to their sitting position.

Figure 11:
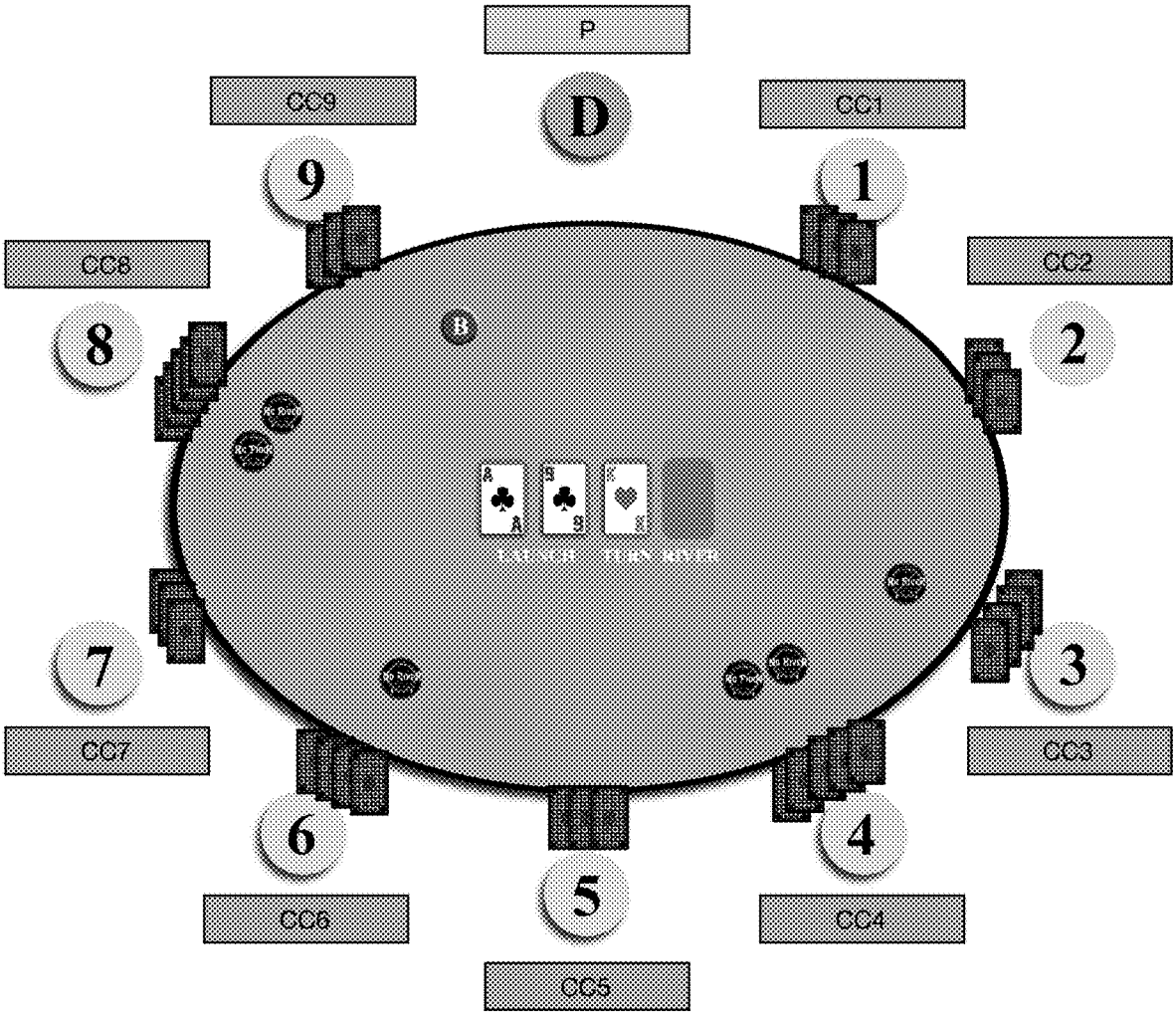

FIG. 11 (Page 59): The processor is programmed to provide the fourth card distribution: The processor is programmed to position a third community card known as 'the Turn', face upward, in the middle of the table, adjacent to 'the Launch' in the rectangle labelled "TURN". Betting Round 4 takes place after the processor positions 'The Turn'. The processor is programmed to limit maximum bet or raise to 400 u per player, with a maximum of 4 raises per player.

Figure 12:
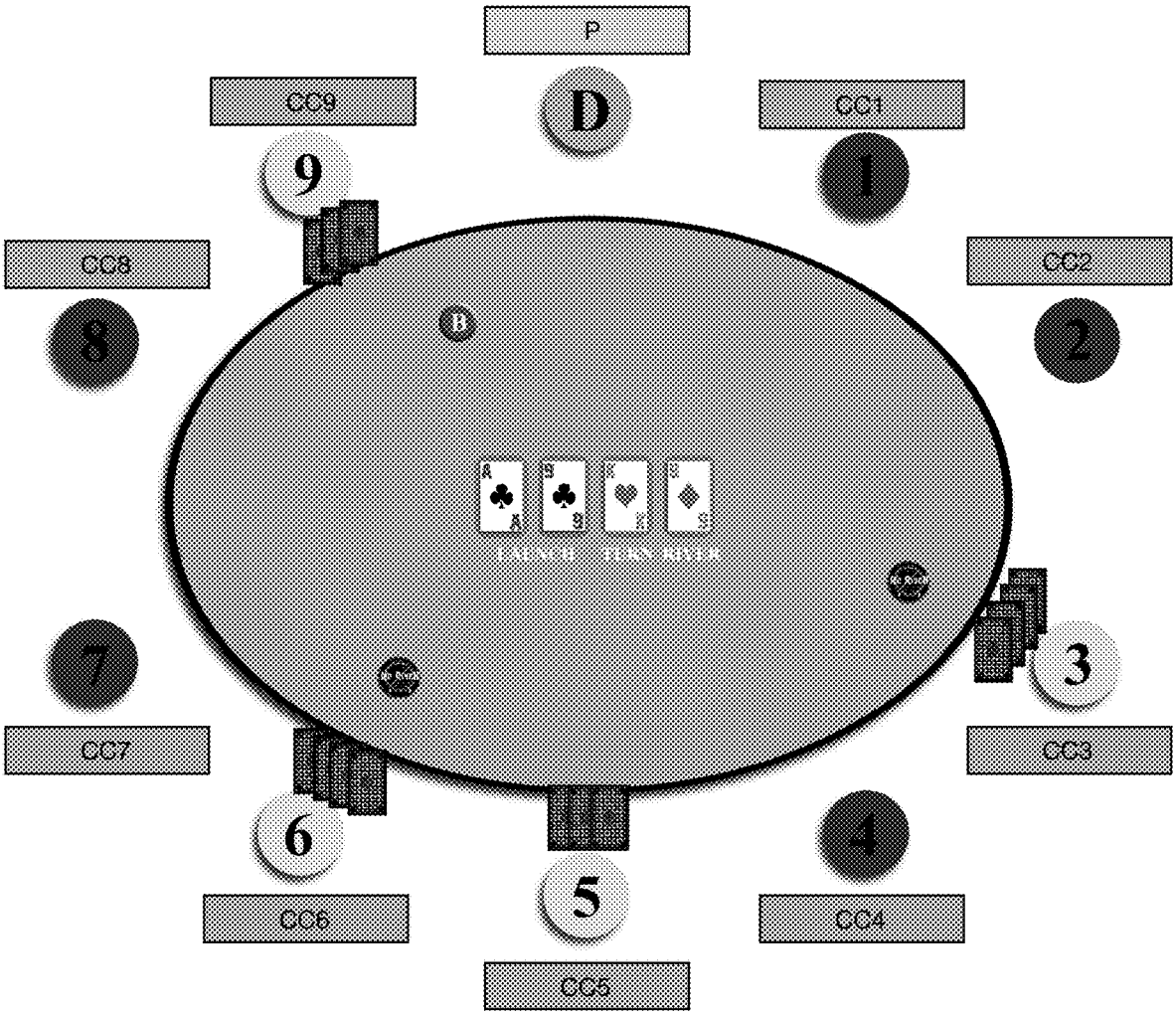

FIG. 12 (Page 60): The processor is programmed to provide the final card distribution, 'The River': The processor is programmed to position a final community card, known as 'the River', face upward, in the middle of the table adjacent to 'the Turn' in the rectangle labelled "RIVER". Betting Round 5 takes place after the processor positions 'The River'. The processor is programmed to limit maximum bet or raise to 500 u per player, with a maximum of 5 raises per player. Darkened Player positions indicate Players who have folded.

Figure 13:
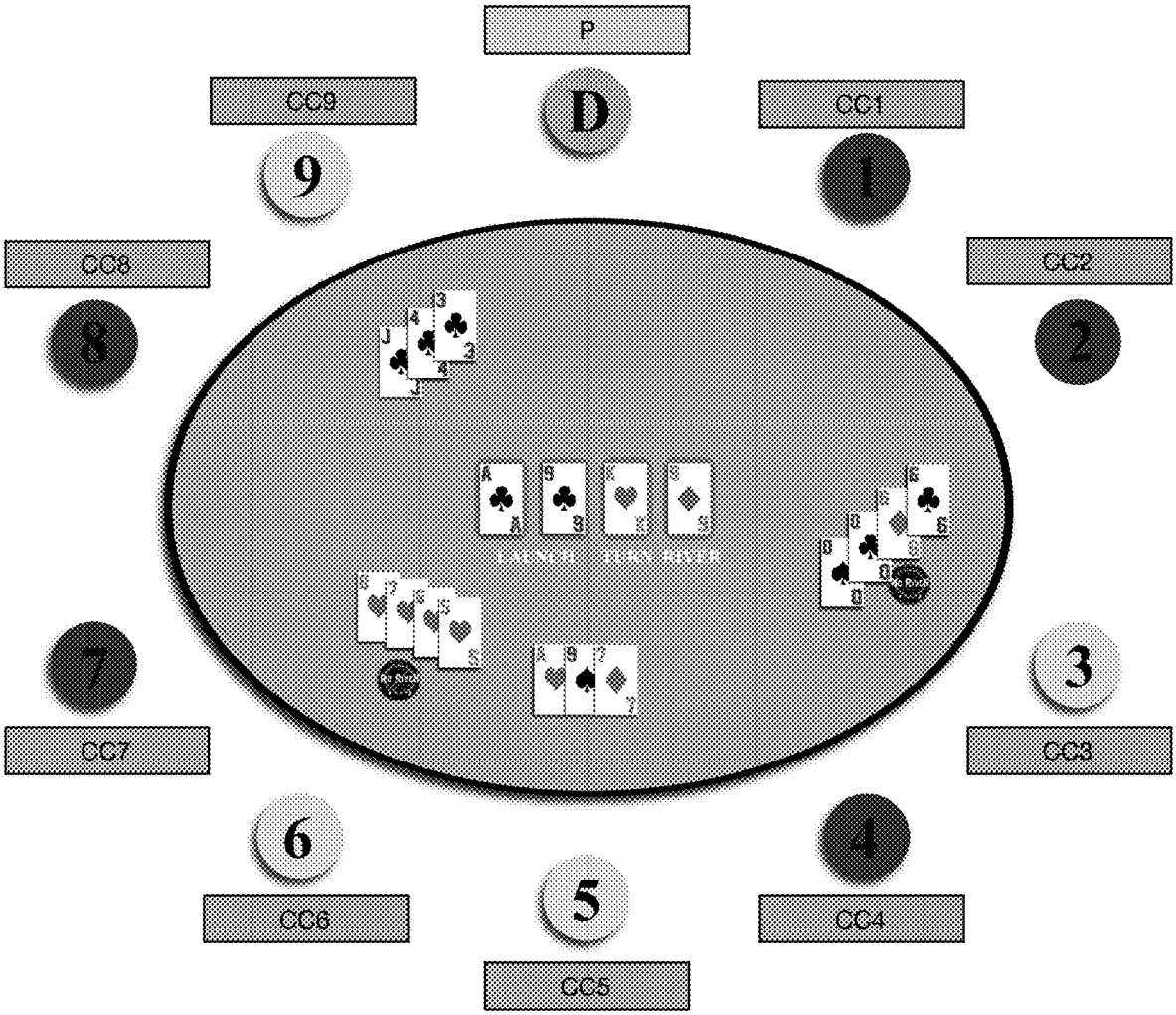

FIG. 13 (Page 61): 'The Showdown': Players' hole cards are automatically revealed and the microprocessor analyses the hand ranking of each player's best 5 card hand to determine the winner. Players competing in the showdown are automatically notified of their hand ranking and finishing position. Darkened Player positions 1, 2, 4, 7, and 8 have folded in Betting Round 5. Player 5 is declared the Winner with a Full House, Ace, Ace, 9, 9, 9.

DETAILED DESCRIPTION OF THE INVENTION

Downloadable digital coding or software for electronic devices that constitute systems and methods for game mechanics and tournament structure of the strategic Poker game variations collectively known as Tennessee Hold 'Em®:

An electronic processor is programmed to provide an innovative game of Poker to a minimum of 3 players and a maximum of 9 players via the internet or a network of electronic gaming machines. Cards are shuffled electronically using a random number generator, known as an RNG. Before play begins, the Dealer "Button", a labelled disc representing the position of the dealer, automatically appears by a randomly chosen player, and that player is said to be 'on the button'. All card distributions and betting proceed in a clockwise direction from the button. All Figures show default variation, Tennessee Riverboat (223). Hand 1 begins as depicted in FIG. 2. After every hand, the dealer button moves to the next player in a clockwise direction.

Programmed Betting Structure:

At the start of tournament play, 'the Banker', an electronic processor, which holds a reserve of virtual chips and directs chip winnings from the "Pot" of each hand to the hand winner, distributes a chip count of 10 or 20 thousand units to each player, where 10,000 u is selected for shorter duration tournaments and 20,000 u for longer duration tournaments. Players select their desired chip count when entering the tournament. Note: 5,000 u units is also permitted for single hand Skill Poker Match play.

a) Similar to the system used in "Texas Hold 'Em", but novel to "Tennessee Hold 'Em®", three players automatically post blinds before the hand begins. The player sitting to the left of dealer automatically places the 'Opening Blind', and is equivalent to ¼ of the 'Big Blind'. The next player to the left (clockwise) automatically posts the 'Small Blind', equivalent to ½ of the 'Big Blind', and the next player to the left (in a clockwise direction) automatically posts the 'Big Blind', equivalent to the agreed limit of betting or raising in betting round 1. Tournament starting Blind Bets are as follows: Opening Blind=25 u, Small Blind=50 u, Big Blind=100 u b) After the three blinds are posted, the first distribution of hole cards to each player is completed, and betting round 1 is programmed to begin with the player sitting to the left of the big blind. All subsequent players must place a bet equal to the big blind to remain in the hand. This is known as 'seeing'. After seeing the big blind, players may also raise up to the equivalent of the 'big blind', or they may fold. Play continues in a clockwise direction around the virtual table to the player who placed the big blind, who is last to act. One raise is allowed per player in the first round of betting.

When betting round 1 is complete, the second card distribution, known as 'the Launch', is automatically dealt. The virtual Dealer is programmed to position 2 community cards within the two shaded left hand rectangles labelled "LAUNCH" in the center of the table, and any player may use these cards in combination with their hole cards to create their best 5 card Poker hand for the 'Showdown'. The first person sitting to the left of the button (who has not folded) is the first to act in all subsequent betting rounds.

In betting round 2, the electronic processor is programmed to allow a maximum bet and raise of 2×Big Blind (200 units), and two raises per player are permitted. In betting round 3, the processor is programmed to allow a maximum bet and raise of 3×Big Blind (300 units), and three raises per player are permitted. In betting round 4, the electronic processor is programmed to allow a maximum bet and raise of 4×Big Blind (400 units), and four raises per player are permitted. In betting round 5, the processor is programmed to allow a maximum bet and raise equal to 5×Big Blind (500 units), and five raises per player are permitted.

After 6 Hands have been played, Blind Bets and all related bets are programmed to double. Therefore, during Hands 1 though 6 (inclusive), if the Big Blind equals 100 units, for Hands 7 though 12 (inclusive) the Big Blind equals 200 units. After 12 Hands have been played, Blind Bets (and all related bets) automatically double again. For Hands 13 or greater, the Big Blind equals 400 units, until only two players remain in the Tournament and prizes are awarded. The total chip count of the winner is divided by the sum of the total chip count of the winner added to the chip count of the Runner-Up, determining the exact percentage of the Tournament Pot that is awarded to the winner. The remainder of the tournament pot is awarded to the Runner-Up. If two or more players are eliminated in the same hand and only one player remains, the entire tournament pot is awarded to the last remaining player.

When any player does not have enough chips to see or raise betting in a hand, that player may use a chip bonus credit from the Banker Dealer (microchip processor) known as "Overdrawn Chips", or 'ODC'. If a player using ODC loses the hand, then those chips bet in that hand are automatically added to the hand winner's chip count total, and the player using ODC is eliminated. If a player using ODC wins that hand, all ODC 'loaned' to that player is programmed to return to the dealer. The microprocessor automatically reclaims any loaned ODC and subtracts that amount from the pot, allowing that player to continue competing in the Tournament. Players requiring bonus ODC are permitted to borrow ODC in any hand, as long as they begin that hand with a positive chip count.

Detailed Description of Programming for 7 Variations of Tennessee Hold 'Em®:

Each variation is identified by name and number. Numerical nomenclature corresponds to the number of cards dealt in each of the first 3 card distributions. The term "Dealer" is used to describe a programmed microprocessor that acts as a virtual dealer and banker. The Dealer's position is indicated by a graphic circular icon referred to as "the Button": This button is displayed as a disk that is programmed to move clockwise to the next player, after each hand. The player indicated by the button is last to act in each betting round, except for the first round of betting, where the player sitting to the left of (the player placing) the 'big blind' is the 'first to act', where 'acting' is defined as betting, checking, raising or folding.

All variations share identical programming for community cards. Community cards are 'shared' cards, programmed to appear in the corresponding labelled rectangles on the simulated baize of the Poker table during the second, fourth and fifth card distributions; specifically, the second card distribution is two cards, which appear in the two left hand most rectangles, labelled "LAUNCH", and the fourth card distribution appears in the third rectangle adjacent to the LAUNCH labelled, "TURN", and the fifth and final card distribution appears in the right hand rectangle labelled, "RIVER", adjacent to the TURN.

Variation 1: "Tennessee Riverboat (223)":

Programming for electronic systems that provide the Poker variation known as "Tennessee Riverboat (223)" is employed as default variation and is described herein.

(1) i: First Card Distribution, aka 'The Hole' (see FIG. 3): The virtual Dealer, a programmed microprocessor, distributes a first single 'hole' card to each individual player, and then distributes a second single 'hole' card to each player. All players now hold 2 exclusive use cards that only that player can view. Note: 'Hole card' is defined as a single player, exclusive use card, which is not visible to opponents. The microprocessor is programmed to calculate the total 'pot', all bets, raises, and wins on players' chip counts, automatically recalculating all balances.

(1) ii: While Players view their hole cards (see FIG. 4), betting Round 1 is programmed to commence with the player sitting to the left of the player who automatically furnished the big blind. In all rounds, betting proceeds in a clockwise direction. To remain in the hand, each player must at least 'see' (place a bet equivalent to) the big blind, and may bet or raise up to a maximum equivalent to the 'Big Blind'. Occasionally, players may fold, if they deem their hole cards are not strong enough to play. Only 1 raise per player is allowed in betting Round 1. The microprocessor is programmed to allow a maximum bet or raise equal to the Big Blind, 100 units at start of play.

(1) iii: Second Card Distribution, aka "The Launch" (see FIG. 5)—The virtual dealer is programmed to distribute a second set of playing cards in the middle of the "table", in the form of two community cards in line, face up, and these two cards, known as "The Launch", are positioned in the rectangles labelled "LAUNCH" on the virtual table. These 2 cards may be used by any individual player to form a winning hand. 'The Launch' consists of 2 community cards in all variations of Tennessee Hold 'Em.

(1) iv: Betting on "The Launch"—Betting Round 2 is programmed to commence with the first player sitting to the left of the dealer 'button' who has not folded: In betting Round 2, each player may either check (if no player bets beforehand), or bet, see or raise up to double the Big Blind (the microprocessor is programmed to allow a maximum of 200 units at start of play), or fold. The microprocessor is programmed to limit each player to two raises.

(1) v: Third Card Distribution, aka "The Boat" (see FIG. 6)—The virtual Dealer is programmed to distribute a third 'hole' card to each individual player; then distribute a fourth single 'hole' card to each individual player and distribute a fifth, final single 'hole' card to each individual player. Each player can now view their own five hole cards known collectively as 'the Boat'*.

* Note: "The Boat": Variations (223), (322), (124), and (421) are all 5 Hole Card games which have identical subsequent phases of card distribution and rounds of betting.

(1) vi: Betting on 'The Boat', Round 3 is programmed to commence with the first player sitting to the left of the dealer 'button' who has not folded: In Betting Round 3, each player may either check (if no player bets beforehand), see, bet or raise up to three times the Big Blind (the microprocessor is programmed to allow a maximum of 300 units at start of play), or fold. The processor is programmed to limit each player to three raises.

(1) vii: In all programmed variations, discards are known as 'Men Overboard'. At the end of Betting Round 3, the virtual Dealer is programmed to permit players to discard, with a notification that states "Men Overboard". In all variations, players must retain a minimum of 3 Hole cards. Each player must choose to shed (discard) 1 or 2 cards from his/her 5 hole cards (known as "The Boat"), or choose to 'stick' with all 5 hole cards which have been dealt. Each player can select 1 or 2 cards to shed, and all discards automatically appear face down on the table by each player's table position. Any player choosing to 'stick' with 4 hole cards is not permitted to use the fourth community card, "the River" in their 5 card, best ranking poker hand during the 'showdown'. Any player choosing to 'stick' with 5 hole cards is permitted to use neither the third community card, "the Turn", nor the fourth community card, "the River" (see FIG. 8, Players 4 and 8) in their 5 card, best ranking poker hand during the 'showdown'.

(1) viii: Countdown and discard reveal—A timer is programmed to count down to zero, limiting the time allowed for selecting discards. When the timer expires, all discards are automatically turned face upward to reveal their rank and suit. (see FIG. 9) When all discards have been viewed, discards are programmed to automatically disappear after approximately 10 seconds. "No River" Markers are programmed to automatically appear on the table by players holding 4 or 5 hole cards, and, in addition, "No Turn" Markers are programmed to automatically appear on the table by any Player holding 5 hole cards. (see FIG. 10)

(1) ix: The "Turn"—The virtual dealer is programmed to distribute a third community playing card, face up, in the middle of the table, in line with the said 2 existing community cards, face up in the rectangle labelled, "TURN", and this card is referred to as the "Turn". (see FIG. 11) The Turn may be used by any individual player to form a winning hand, with the exception of players who have chosen to hold 5 hole cards.

(1) x: Betting on the "Turn"—Betting Round 4 is programmed to commence with the first player sitting to the left of the dealer 'button' who has not folded: In Round 4, each player may either check (if no player bets beforehand), or bet or raise up to the limit of betting Round 4 (Four times the Big Blind), or see or call the previous bet and subsequent raise or raises, or may choose to fold. The microprocessor is programmed to allow a maximum of four raises per player with a maximum bet or raise of 400 units, at start of play.

(1) xi: The "River"—The dealer is programmed to distribute a forth, final community playing card in the middle of the table, in line with the said 3 existing community cards, face up in the rectangle labelled, "RIVER", and this card, referred to as the "River" (see FIG. 12), may be used by any individual player to form a winning hand, with the exception of any players choosing to 'stick' with 4 or 5 hole cards, who are not permitted to use the River card in their 5 card, best ranking poker hand during the 'Showdown'. (see (1) xiii)

(1) xii: Betting on the "River"—Betting Round 5 is programmed to commence with the first player sitting to the left of the dealer 'button' who has not folded: a player may either check (if no player bets beforehand), or bet or raise up to the limit of betting Round 5 (Five times the big blind, 500 units at start of play), or see, or call the previous bet and subsequent raise or raises, or may choose to fold. In betting Round 5, the microprocessor is programmed to allow a maximum of five raises per player with a maximum raise of 500 units, at start of play.

(1) xiii: The "Showdown" (see FIG. 13)—Showdown Rules: In the "Showdown", all remaining players' hole cards are revealed automatically, and in all game variations of Tennessee Hold 'Em, the computer processor is programmed to automatically analyse and select players' best ranking 5 card poker hands from 7 eligible cards. There are two different procedures, depending on whether or not there was betting on the final, fifth round of betting:

a) If there was no betting on Round 5, after the River, the showdown is programmed to proceed in the same order as all other actions, starting with the player sitting left of the button, automatically revealing that player's cards first and proceeding clockwise to the button, automatically revealing each subsequent player's cards is a clockwise direction.

b) If there was betting in Round 5, after the River, the computer processor is programmed to first reveal the hole cards of the last player to take an aggressive action, defined as either betting or raising. Then the showdown proceeds around the table clockwise without regard to where the button is. Next, the computer processor is programmed to automatically reveal each subsequent player's cards is a clockwise direction. In both cases, the player with the highest ranking 5 card Poker hand (of 7 permitted cards) is designated the Winner of that hand and awarded the sum total of all virtual chips bet in that hand, which is added the that player's digital chip count. If 2 players hold identical ranking hands, the microprocessor is programmed to split the pot equally between those two players.

(1) xiv: Overdrawn Chips (ODC): In any hand, when any player does not have enough chips to cover bets and raises, the Bank is programmed to supply that player with enough bonus credit, known as ODC, to see, bet or raise until the showdown. If any player drawing ODC loses that hand, they are automatically eliminated from the tournament. I they win, their total ODC is automatically subtracted from the awarded pot of that hand and that player may continue competing in the tournament.

Variation (2): "Tennessee Gambler (222)"=4 Hole Cards

* Note: Where indicated, see Variation 1: "Tennessee Riverboat (223)"

(2) i and (2) ii: see Variation 1: (1) i, and (1) ii (2) iii and (2) iv: see Variation 1: (1) iii and (1) iv (2) v: Third Card Distribution, aka "The Boat"—The virtual Dealer, controlled by a programmed microprocessor, distributes a third 'hole' card to each individual player; then distributes a fourth single 'hole' card to each individual player. Each player now views his or her four hole cards known collectively as 'the Boat'.

(2) vi: see Variation 1: (1) vi (2) vii: Discards are known as 'Men Overboard'. At the end of Betting Round 3, The virtual Dealer, controlled by a programmed microprocessor, 'invites' players to discard, with a notification that states "Men Overboard!" to inform players they are now permitted to discard (shed one card). Players must retain a minimum of 3 Hole cards. Each player must choose to shed (discard) 1 card from his/her 4 hole cards ("The Boat"), or choose to 'stick' with all 4 hole cards which he/she has been dealt. Each player selects which card to shed and all discards automatically appear face down on the table where the corresponding player's table position is located, or any player may decide that he or she wants to continue holding, all 4 Hole cards. Any player choosing to 'stick' with 4 hole cards is automatically excluded from using the fourth community card, the "River" in their 5 card, best ranking poker hand during the 'showdown' via the processor programming.

(2) viii: Countdown and discard reveal—A timer is programmed to automatically appear and count down to zero, limiting the time allowed for selecting discards. After the timer expires, all discards are automatically turned face upward to reveal their rank and suit. (see FIG. 9) When all discards have been exposed, discards automatically disappear after 20 seconds, and "No River" Markers automatically appear on the table by players holding 4 hole cards.

(2) ix: see Variation 1: (1) ix.

(2) x: see Variation 1: (1) x.

(2) xi: The "River"—The virtual dealer is programmed to distribute a forth, final community playing card in the middle of the table, in line with the said 3 existing community cards, face up, in the rectangle labelled, "RIVER", and this card, referred to as the "River", may be used by any individual player to form a winning hand, with the exception of any players choosing to 'stick' with 4 hole cards. In this case, said player or players is/are excluded from using the "River" in their 5 card, best ranking poker hand during the 'Showdown' via the processor programming.

(2) xii: See Variation 1: (1) xii (2) xiii: "The Showdown"—Showdown Rules: (see Variation 1: (1) xiii)

(2) xiv: See Variation 1: (1) xiv

Variation (3): "Tennessee Hustler (322)"=5 Hole Cards (3) i: First Card Distribution, aka the "Hole': The virtual Dealer is programmed to distribute a first single 'hole' card to each individual player, and then distribute a second single 'hole' card to each individual player. Next, the Dealer is programmed to distribute a third single 'hole' card to each individual player. Each player now can view 3 exclusive use cards that only that player can view.

(3) ii: See Variation 1: (1) ii (3) iii and (3) iv: see Variation 1: (1) iii and (1) iv (3) v: Third Card Distribution, aka "The Boat", (FIG. 6) The virtual Dealer is programmed to distribute a fourth 'hole' card to each individual player, then distribute a fifth single 'hole' card to each individual player. Each player can now see his/her five hole cards known collectively as 'the Boat'.

(3) vi: See Variation 1: (1) vi (3) vii: See Variation 1: (1) vii (3) viii: See Variation 1: (1) viii (3) ix: See Variation 1: (1) ix (3) x: See Variation 1: (1) x (3) xi: See Variation 1: (1) xi (3) xii: See Variation 1: (1) xii (3) xiii: See Variation 1: (1) xiii (3) xiv: See Variation 1: (1) xiv Variation (4): "Tennessee Big Hole (321)"=4 Hole Cards (4) i: See Variation (3) i (4) ii: See Variation 1: (1) ii (4) iii: and (4) iv: See Variation 1: (1) iii and (1) iv (4) v: See Variation 2: (2) v (4) vi: See Variation 1: (1) vi (4) vii: See Variation 2: (2) vii (4) viii: See Variation 2: (2) viii (4) ix: See Variation 1: (1) ix (4) x: See Variation 1: (1) x (4) xi: See Variation 2: (2) xi (4) xii: See Variation 1: (1) xii (4) xiii: See Variation 1: (1) xiii
(4) xiv: See Variation 1: (1) xiv Variation (5): "Tennessee Red Dog (124)"=5 Hole Cards (5) i: First Card Distribution, aka the 'Hole': The virtual Dealer is programmed to distribute a first single 'hole' card (single player, exclusive use card) to each individual player. Each player now sees one exclusive use card that only that player can view.
(5) ii: See Variation 1: (1) ii
(5) iii: and (5) iv: See Variation 1: (1) iii and (1) iv
(5) vi: See Variation 1: (1) vi
(5) v: Third Card Distribution, aka "The Boat" (FIG. 6). The virtual Dealer, is programmed to distribute a second hole card to each individual player, and distribute a third hole card to each player. Next, the virtual Dealer is programmed to distribute a fourth 'hole' card to each individual player, then distribute a fifth single 'hole' card to each individual player. Each player can now see his/her five hole cards known collectively as 'the Boat'.
(5) vi: See Variation 1: (1) vi
(5) vii: See Variation 1: (1) vii
(5) viii: See Variation 1: (1) viii
(5) ix: See Variation 1: (1) ix
(5) x: See Variation 1: (1) x
(5) xi: See Variation 1: (1) xi
(5) xii: See Variation 1: (1) xii
(5) xiii: See Variation 1: (1) xiii
(5) xiv: See Variation 1: (1) xiv Variation (6): "Tennessee Slow Hand (123)"=4 Hole Cards (6) i: First Card Distribution, aka 'The Hole': The virtual Dealer is programmed to distribute a first single 'hole' card (single player, exclusive use card) to each individual player. Each player can now see one exclusive use card that only that player can view.
(6) ii: See Variation 1: (1) ii
(6) iii: and (6) iv: See Variation 1: (1) iii and (1) iv
(6) v: Third Card Distribution, aka "The Boat" (see FIG. 3*a*)—The virtual Dealer is programmed to distribute a second 'hole' card to each individual player, then distribute a third single 'hole' card to each individual player, and distribute a fourth, final single 'hole' card to each individual player. Each player can now see his/her exclusive use four hole cards known as 'the Boat'.
(6) vi: See Variation 1: (1) vi
(6) vii: See Variation 2: (2) vii
(6) viii: See Variation 2: (2) viii
(6) ix: See Variation 1: (1) ix
(6) x: See Variation 1: (1) x
(6) xi: See Variation 2: (2) xi
(6) xii: See Variation 1: (1) xii
(6) xiii: See Variation 1: (1) xiii
(6) xiv: See Variation 1: (1) xiv Variation (7): "Tennessee Steamer (421)"=5 Hole Cards (7) i: First Card Distribution, aka 'The Hole': The virtual Dealer, is programmed to distribute a first single 'hole' card to each individual player, then distribute a second single 'hole' card to each individual player, then distribute a third single 'hole' card to each individual player, then distribute a fourth single hole card to each individual player. Each player can now see 4 exclusive use cards that only that player can view.
(7) ii: See Variation 1: (1) ii
(7) iii: and (7) iv: See Variation 1: (1) iii and (1) iv
(7) v: Third Card Distribution, aka "The Boat" (see FIG. 6)—The dealer button distributes a fifth, final single 'hole' card to each individual player. Each player now holds five hole cards known collectively as 'the Boat'.
(7) vi: See Variation 1: (1) vi
(7) vii: See Variation 1: (1) vii
(7) viii: See Variation 1: (1) viii
(7) ix: See Variation 1: (1) ix
(7) x: See Variation 1: (1) x
(7) xi: See Variation 1: (1) xi
(7) xii: See Variation 1: (1) xii
(7) xiii: See Variation 1: (1) xiii
(7) xiv: See Variation 1: (1) xiv Showdown: Hand Ranking:

The microprocessor is programmed to analyse each player's best ranking 5 card Poker hand of 7 permitted cards, and determines and displays which hand has won, as well as second best hand, and third best hand, etc. . . . down to the lowest ranking hand in the showdown.

The microprocessor is programmed to exclude players choosing to hold four hole cards from using 'the River'.

The microprocessor is programmed to exclude players choosing to hold five hole cards from using 'the Turn' or 'the River'.

Best 5 card hands from 7 eligible cards. Hand Ranking is shown highest value first, and lowest value last:

Straight Flush—Any 5 card hand consisting of 5 cards of consecutive ranking with all cards of the same suit. In the rare event that two players have straight flushes with the same high card (in different suits), those players split the pot. Highest possible ranking hand is a Straight Flush, known as a Royal Flush, which is Ace High 4 of a Kind—Any 5 card hand consisting of 4 of 5 cards of the same Ranking. If two or more players have the same four of a kind, then the higher or highest fifth card kicker determines the winner.

Full House—Any 5 card hand consisting of 3 of a Kind and a Pair. If two or more players have a full house, the player with the best 3 of a Kind wins. If those 3 of a Kind are equal in rank, the player with the higher Pair wins. If 2 players have the same ranked 3 of a Kind and the same ranked Pair, those players share the pot.

Flush—Any 5 card hand consisting of 5 cards in the same suit. If two of more players have a flush, then the player with the highest card in their flush wins. If the highest cards are equal, the second highest ranked cards are compared, and so on down to the fifth card. In the rare event that 2 players have identically ranked Flushes in different suits, those players split the pot.

Straight—Any 5 card hand consisting of 5 cards of consecutive ranking. If two or more players have the same high card in their respective straights, the pot will be split between those players.

3 of a Kind—Any 5 card hand consisting of 3 cards of the same Ranking and 2 other rankings. If two or more players have the same three of a kind in their best 5 card hand, the two remaining cards, known as 'kickers', determine the winner. If both the kickers are also equal, the pot will be split between those players.

Two Pair—Any 5 card hand consisting of 2 matching pairs of cards of the same Ranking. If two or more players have the same two pair, then the fifth card 'kicker' determines the winner. If the kickers are also equal, the pot will be split between those players.

One Pair—Any 5 card hand consisting of a matching pair of cards of the same Ranking. If two or more players have the same pair, then the highest of the three remaining cards (known as kickers) determines the winner. If the highest kickers are also equal, then the second highest kickers are compared. If the second highest kickers are also equal, the third, final 'kicker' is compared to determine a winner. If the pair, and all 3 kickers are equal, the pot will be split between those players.

High Card—If two or more players have the same highest ranking card, then the second highest card (and so on, to the fifth card) determines the winner. If 2 or more players hold identically ranked 5 card hands, the pot will be split between those players.

The invention claimed is:

1. A system comprising:

electronic gaming machines each comprising a display device, a memory device storing instructions and a processor, wherein when the respective instructions are executed by the respective processor, the instructions cause the respective processor to, in conjunction with at least the respective display device:

(I) provide a poker game for 3 to 9 players as a tournament competition with a virtual dealer represented by a disc marker, known as a 'button', on a graphic depiction of a bespoke card table featuring four labelled rectangles, which correspond to a series of named rounds of dealing and betting;

(II) provide a 52 card deck of standard playing cards with 13 ranks in each of 4 suits, each card having a value which may contribute to a winning 5 card poker hand;

(III) set a parameter to rotate the Dealer 'Button' to the next player in a clockwise position each time a new hand begins;

(IV) indicate and automatically furnish 3 Blind Bets for the first 3 players sitting to the left of the 'button';

(V) limit maximum betting and allowed raises per player in each of five progressive rounds of betting;

(VI) distribute a first single 'hole' card or set of 'hole' (single player, exclusive use) cards to each individual player playing the poker game; specifically, one, two, three or four cards, depending upon the game variation selected, the first set of playing cards comprising cards from said card deck and having a card value which can only be used by each individual holding said 'hole' cards distributed in a manner so that only individual players receiving the cards can view;

(VII) distribute a second set of playing cards within the rectangles labelled, "LAUNCH" in the middle of the table, comprising two community cards, face up, collectively known as 'the Launch'; the second set of playing cards comprising cards from said card deck and having a card value which all players can view and use to form a winning hand;

(VIII) distribute a third set of playing cards by distributing additional hole cards face down on the table (one, two, three or four cards, depending upon the game variation played), in a manner so that only individual players receiving said cards can view and this third distribution of cards is collectively known as "The Boat";

(IX) provide each player with the option to hold or discard (shed) selected hole cards, collectively known as "Men Overboard"; where selected discards automatically appear face down on the table once selected;

(X) expose discarded hole cards, as nominated by each player in turn; specifically, reveal each player's discards;

(XI) remove the exposed, discarded hole cards from the Table;

(XII) place "No River" and "No Turn" notification disc markers alongside the table position of players choosing to hold more than 3 hole cards;

(XIII) distribute and display a third community playing card, as known as "the Turn", in the middle of the table within the rectangle labelled, "TURN", adjacent to "the Launch", to form three community cards; said third community playing cards comprising cards from the playing deck and having a card value in which each individual player can view and use to form a winning hand, with the exception of any player choosing to hold 5 hole cards;

(XIV) distribute and display a fourth, final playing card, known as "the River" in the middle of the table within the rectangle labelled, "RIVER", adjacent to "the Turn" to form four community cards; said fourth community playing card comprising cards from said playing deck and having a card value in which each individual player can view and use to form a winning hand, with the exception of any player choosing to hold 4 or 5 hole cards;

(XV) indicate which player plays next after any round of card distribution, card shedding or round of betting, known as 'turn-taking';

(XVI) provide each player with the option to bet, raise, check or fold, or to shed (discard) a card or cards, or to 'stick', defined as choosing to hold more than 3 hole cards, during each appropriate round of betting;

(XVII) exclude any individual player who chooses to 'stick' with five hole cards, from using the third community playing card, the 'Turn', to form a winning hand and notify all players by placing two discs, labelled, "No Turn" and "No River" by that player;

(XVIII) exclude any individual player who chooses to 'stick' with four or five hole cards, from using the forth community playing card, the 'River' to form a winning hand and notify all players by placing a disc labelled "No River" by that player;

(XIX) add a red filter or red marker to a player's 'avatar' when any player goes 'all-in' and uses "Overdrawn Chips", known as 'ODC';

(XX) provide any player who goes all-in on any hand with a chip 'loan', known as "ODC", Overdrawn Chips, whereby that player may bet, raise, see within parameters and limits programmed into each hand;

(XXI) retrieve "ODC" loaned to any player who draws it and wins that hand, and redirect any ODC bet during the hand to the hand winner, so when a player drawing ODC loses that hand, he/she is automatically eliminated from the Tournament and that player's avatar is darkened or removed; and (XXII) record all virtual chips bet during any given hand, and direct the 'pot' to the Winner of that hand, where all chip calculations are automatic and Winner's chip count is credited automatically.

2. The system of claim 1, wherein when the respective instructions are executed by the respective processor, the instructions cause the respective processor to, in conjunction with at least the respective display device determine which players automatically place the 3 different blind bets, where all programmed variations share the placement of the three blind bets before each hand begins, with the benefit that, the third additional blind bet improves upon traditional placement of 2 blind bets by impelling a third player to have a vested interest in the hand before it starts; whereby the first blind bet, known as the 'Opening Blind' (OB) is automatically positioned by the player sitting to the left of the Button, and the second blind bet, known as the 'Small Blind' (SB) is automatically positioned by the second player sitting to the left of the Button, and the third blind bet, known as the 'Big Blind' (BB) is automatically positioned by the third player sitting to the left of the 'Button', where The Big Blind equals double the Small Blind and the Small Blind equals double the Opening Blind, so the Big Blind therefore equals four times the Opening Blind (40B=2SB=BB); so if OB=25 units, SB=50 units, and BB=100 units.

3. The system of claim 1, wherein when the respective instructions are executed by the respective processor, the instructions cause the respective processor to, in conjunction with at least the respective display device:

(I) notify players that they must decide whether to shed 1 or 2 personal 'hole' cards, or to retain all hole cards which allows or excludes players from the use of the final two community cards, known as the "Turn" and the "River";

(II) enable players to select which cards they wish to discard within a timer countdown; automatically place the selected discards on the table in front of each player, face down, without revealing them to the other players, until all players have discarded, or indicate that they wish to 'stick', by waiting until the timer counts down to zero; and (III) automatically reveal the discards before they automatically disappear, allowing observant players insight into each opponent's hand, while altering the odds of getting a favourable "TURN" or "RIVER", and providing innovative tactical methods of bluffing, (which do not exist in established Poker variations); whereby "No River" marker discs automatically appear adjacent to players who hold 4 or 5 hole cards, and "No Turn" marker discs also appear adjacent to any player who chooses to hold 5 hole cards.

4. The system of claim 1, wherein when the respective instructions are executed by the respective processor, the instructions cause the respective processor to, in conjunction with at least the respective display device, calculate, direct and control betting during each hand in a linear progression, specifically as follows: after the first card distribution, in Betting Round 1, the Big Blind equals 100 units, and in betting round 1, maximum bet or raise equals the Big Blind (BB), and one raise is allowed per player; where in betting round 2, maximum bet or raise equals 2×Big Blind=200 units, and 2 raises per player are permitted, and in betting round 3, maximum bet or raise=3×Big Blind=300 units, and 3 raises per player are permitted, and in betting round 4, maximum bet and raise=4×Big Blind=400 units, and 4 raises per player are permitted, and following the same progression, in betting round 5, maximum bet and raise=5×Big Blind=500 units, and 5 raises per player are permitted; where blinds and all related bets double after Hand 6, and double again after Hand 12; for example if Big Blind=100 units during Hands 1-6, Big Blind=200 units during Hands 7-12, and Big Blind=400 units from Hand 13 until the completion of the tournament.

5. The system of claim 1, wherein when the respective instructions are executed by the respective processor, the instructions cause the respective processor to, in conjunction with at least the respective display device, eliminate complex 'side pot betting' and deter 'chip bullying' by providing a more equitable competition by providing temporary chip credit, allowing players to compete in any given hand to completion (until the Showdown), and via calculating winnings, whereby two players may benefit from tournament winnings; specifically, if any player does not have enough chips to cover the bet or raises during any hand of the Tournament, the virtual dealer is programmed to provide enough chip credit for that player to complete that hand, and this credit is known as ODC, Overdrawn Chips; wherein ODC is automatically available to any player starting a hand with a positive chip count; whereby any player who draws ODC, must win that hand or face elimination, so when only 3 players remain, if the third player is eliminated, the Tournament ends, and the chip counts of both remaining players are automatically counted and totaled; whereby the winner's and runner-up's chip counts are divided by the total chip count to determine the proportional percentage of the Tournament Pot that will be awarded to the winner and runner-up, noting specifically that, the winner is defined as the player having the largest chip count and runner up is defined as the player having the second largest (positive) chip count, but if the runner up has a negative chip count, the full Tournament Pot is awarded to the winner, and if a plurality of players are eliminated after the same hand, when only one or two remain, the tournament is programmed to end, and tournament pot winnings are automatically awarded.

6. The system of claim 1, wherein when the respective instructions are executed by the respective processor, the instructions cause the respective processor to, in conjunction with at least the respective display device:

(I) display a graphic representation depicting a baize playing surface on a simulated Poker table for use in Tennessee Hold 'Em® Tournaments on any electronic device including, but not limited to, electronic gaming machines, computers, smart phones and pads and televisions, as a graphic representation, specifically as follows: four rectangles are marked in the centre of the virtual table, and the first two rectangles are labelled, "LAUNCH" and are positioned centrally to the right of the Dealer (and the left of the viewer, as seen in FIG. 1);

(II) provide the second card distribution, two community cards, known as 'the Launch', positioned face upward within those rectangles; and the Third Rectangle, labelled "TURN", is positioned centrally, to the right of, and adjacent to the Launch, (as seen in FIG. 1), and the microprocessor is programmed to (III) provide the fourth card distribution, which is the third community card known as the 'Turn', positioned face upward within the third rectangle; and (IV) provide the fifth card distribution, which is the fourth community card known as the 'River', positioned face upward within the fourth Rectangle, labelled "RIVER", which is positioned centrally, to the right of, and adjacent to the TURN, (as seen by the viewer in FIGS. 1-13).

* * * * *